US006367088B1

(12) United States Patent
Bergemann

(10) Patent No.: US 6,367,088 B1
(45) Date of Patent: Apr. 9, 2002

(54) DECORATIVE EMBELLISHMENT FOR CLOTHING

(75) Inventor: Eugene P. Bergemann, 4200 Forest Ave., Downers Grove, IL (US) 60515

(73) Assignee: Eugene P. Bergemann, Downers Grove, IL (US)

( * ) Notice: Subject to any disclaimer, the term of this patent is extended or adjusted under 35 U.S.C. 154(b) by 0 days.

(21) Appl. No.: 09/625,539

(22) Filed: Jul. 26, 2000

(51) Int. Cl.[7] ..... A41D 25/02
(52) U.S. Cl. ..... 2/244; 2/145
(58) Field of Search ..... 2/244, 145, 246, 2/251, 144, 146, 156, 148, 149, 150, 151, 152.1; D2/609

(56) References Cited

U.S. PATENT DOCUMENTS

| | | | | | |
|---|---|---|---|---|---|
| 125,305 | A | * | 4/1872 | Kahn | |
| 228,460 | A | * | 6/1880 | Hancock | |
| 364,891 | A | | 6/1887 | Bragdon | |
| 559,425 | A | | 5/1896 | Weissman | |
| 1,299,582 | A | | 4/1919 | Kvistad | |
| 1,342,906 | A | | 6/1920 | Herst | |
| 1,660,165 | A | | 2/1928 | Hogan | |
| 1,742,675 | A | | 1/1930 | Webb et al. | |
| D92,255 | S | | 5/1934 | Kotzen | |
| 2,163,857 | A | | 6/1939 | Smith | 2/102 |
| 2,466,131 | A | * | 4/1949 | Taborski | 2/151 |
| 2,641,766 | A | * | 6/1953 | Taborski | 2/151 |
| 2,707,786 | A | | 5/1955 | Stoner | 2/119 |
| 3,127,617 | A | | 4/1964 | Bonzi | 2/96 |
| 3,151,332 | A | * | 10/1964 | Chambon | 2/128 |
| 3,158,872 | A | | 12/1964 | Pantzke | 2/115 |
| D202,256 | S | | 9/1965 | Moran, Jr. | D3/26 |
| 3,230,547 | A | | 1/1966 | Moran, Jr. | 2/119 |
| 3,484,974 | A | * | 12/1969 | Culmone | 40/129 |
| 3,628,192 | A | * | 12/1971 | Artz | 2/130 |
| 3,639,916 | A | * | 2/1972 | Vaughn | 2/130 |
| D232,986 | S | | 10/1974 | Beck | D2/354 |
| D281,637 | S | | 12/1985 | Stubrick | D2/184 |
| D297,583 | S | | 9/1988 | Hall | D2/227 |
| 4,933,991 | A | * | 6/1990 | Love | 2/115 |
| 5,136,726 | A | * | 8/1992 | Kellin et al. | 2/244 |
| 5,253,366 | A | * | 10/1993 | Marlo et al. | 2/145 |
| D349,181 | S | | 8/1994 | Cheng | D2/842 |
| 5,416,928 | A | * | 5/1995 | Koenig | 2/244 |
| D364,032 | S | | 11/1995 | Caley | D2/861 |
| D364,952 | S | | 12/1995 | Cheng | D2/830 |
| D369,013 | S | | 4/1996 | Hoff | D2/717 |
| 5,524,651 | A | * | 6/1996 | Young et al. | 132/275 |
| 5,803,266 | A | * | 9/1998 | Blackwelder | 206/575 |
| 6,047,402 | A | | 4/2000 | Chester-Salter | 2/46 |
| 6,076,194 | A | * | 6/2000 | Purkett | 2/279 |
| 6,161,224 | A | * | 12/2000 | Tuetken | 2/244 |

* cited by examiner

*Primary Examiner*—John J. Calvert
*Assistant Examiner*—Alissa L. Hoey
(74) *Attorney, Agent, or Firm*—Welsh & Katz, Ltd.

(57) ABSTRACT

A garment embellishment, having no neck or collar attachment means, is provided allowing the wearer of casual clothing to quickly attach the embellishment and thereby formalize his clothing. The embellishment may take the place of a more formal necktie, bolo tie, or scarf and may be easily transported in a pocket, purse or briefcase so that it is immediately available to help dress-up casual clothing. Further, the embellishment may be used as a novelty at parties, political rallies and other places where the display of a message may be desired. The embellishment may be removably attached to clothing by use of double-sided adhesives, hook and loop fasteners, pins, snaps, button loops or other buttoning attachments. The embellishment may be worn with a jacket or blazer or alone on a shirt or blouse to provide more decoration to clothing.

29 Claims, 4 Drawing Sheets

DECORATIVE EMBELLISHMENT FOR CLOTHING

FIELD OF THE INVENTION

The present invention concerns a novel decorative embellishment for clothing allowing casual clothing to be dressed up as needed for more formal situations.

BACKGROUND OF THE INVENTION

Presently, there is a trend in offices, schools and other places of employment and/or leisure towards casual attire. Ladies and gentlemen have taken to wearing casual clothing that permits a more comfortable working or learning environment and presents a more egalitarian society. Further, vacationers and tourists have become more casual as formal clothing is rarely worn during vacations and the extra weight in transporting formal clothing on vacation makes carrying such clothes impractical. It has become rare to find vacationers traveling with formal attire.

As a result, it is often the case that when there is a call for a more formal look, such as when a client makes a surprise visit to an office, upon entering an upscale restaurant, or when visiting a tourist site that requires a more polished appearance, many persons are now not appropriately dressed for the situation. In the case of tourists far from home such situations present the option of missing out on an interesting site, event, or restaurant, or purchasing new clothes (typically at premium prices) at the vacation site.

Currently, casual wear, and most especially business casual wear, often includes a casual shirt or pullover, casual slacks and often times a sports jacket or blazer for gentlemen, and similar items for ladies. Leisure casual wear, including that worn by tourists, includes the above ensemble with, at times, the more casual T-shirt replacing the casual shirt. With such an ensemble (with or without a jacket or blazer), a tie, bolo or scarf may often times provide the added embellishment to allow casual attire to rise to the level needed for the situations noted above. However, ties and scarves are not comfortable to wear, are not always easy to fashion to one's clothing quickly, and are generally not convenient to transport in a pocket (which generally will cause the tie or scarf to become wrinkled, or may cause the misplacing or damaging of the slide of a bolo tie, defeating the initial purpose of dressing up an ensemble) for use when needed. Further, a well formed tie or scarf requires skill to fashion correctly and, unfortunately, this skill is becoming more rare in this era of casual clothing. Also, neckties require buttoned collars which are often tight and restricting causing discomfort to the wearer often resulting in the pulling down of the tie and opening of the collar, and a slovenly appearance. Further, in instances where one is wearing a collarless shirt, T-shirt or other type of pullover shirt, a tie becomes impractical as such a look is the antithesis of formality.

It would be desirable to have an article of clothing or an embellishment to casual clothing that would provide the added touch to bring such clothing some formality. It would, further, be desirable to have such an embellishment or article of clothing be easily and inexpensively produced and be easily transportable and/or purchasable in a large variety of locations, including vending machines. It would be desirable to have an article or embellishment that could be quickly and easily placed on one's person and as easily removed and stored (for a subsequent use) after use. It would also be desirable to have such an article of clothing or embellishment to clothing that could be quickly and inexpensively provided as a party favor, or worn by a group, to present a message, such as "happy birthday", for a party, and "don't eat grapes" as a message.

The present invention provides a solution to these problems by easily, quickly, conveniently and inexpensively embellishing casual clothing. The present invention also provides an article of clothing or an embellishment to clothing that is easy and inexpensive to produce and is readily available for use in a variety of situations.

SUMMARY OF THE INVENTION

In accordance with the present invention, a garment embellishment for use with casual clothing is provided. In one embodiment, the garment embellishment is used in association with a jacket or blazer and casual attire. The garment embellishment comprises an ornamental article having one of a plurality of forms and being free of any means for attachment to the neck or collar. The ornamental article can be removably applied to the torso of a first garment such that the garment is decorated and made more formal or more colorful, depending on the intent of the wearer. The ornamental article can be applied to the torso of a first garment, worn beneath a jacket or blazer within the generally V-shaped opening typically formed in the front of a jacket or blazer, such that the article decorates the exposed area of the first garment. When used with a jacket, a blazer or even a suit or tuxedo, the present invention provides a more formal look, as, or almost as formal, as that achieved by wearing a neck tie, bolo tie, ascot or scarf.

The ornamental article can be made of cloth, which can be laid flat or folded to a pleasing shape and which can be secured to batting. The ornamental article can also be made of paper, which can be cut to a desired shape, and which can have a pattern, drawing or picture printed thereon by an artist or by a color printer (for example, one attached to a personal computer) or copier. The ornamental article can also be made of other materials such as metal sheets, woven metals, cardboard or other card stock, plastic, vinyl, leather (or other hides or parchment) plain or decorated to the taste of the wearer. It will be understood by persons having skill in the art that wide varieties of materials, shapes and designs, with any variety of decorations or decorative elements can be used without departing from the novel scope of the present invention. It is to be understood that the ornamental article of the present invention may be made of any shape, such as a traditional necktie shape or the shape of a bow-tie, ascot, scarf; or can be made triangular, circular, oval, polygonal or random shapes, without departing from the novel scope of the present invention. It is an element of the present invention that the shape of the article be left to the wearer so that the wearer may exercise his creativity and attitude in selecting or creating an ornamental article.

In the preferred embodiment of the present invention, the ornamental article of the present invention can be applied at any vertical position on the torso of the shirt or blouse of the wearer. The wearer may decide to place the ornamental article near the neck line, such that the article resembles a necktie, or the wearer may place the article in a more centered position. In the more centered position, the article will not be confused with a necktie, giving the user a more free form decoration as desired. It is to be understood that the position of placement, on the torso, of the ornamental article of the present invention is to be left to the wearer as an element of the decorative aspects of the ornamental article, the wearer's taste and fashion sense, and the method of use of the present invention.

In one embodiment of the invention, the garment embellishment is attached by an adhesive, typically a double-sided adhesive tape, to a shirt. In another embodiment a hook and loop fastener, such as a Velcro® brand fastener, can be used to apply the embellishment to a garment. In still another embodiment, one or more button holes or loops are applied to the back of the garment embellishment and it is attached to one or more buttons on a shirt or blouse. In another embodiment, hook and loop fastener elements are provided as button covers and on the back of the ornamental article such that adhesive need not be placed on a shirt in order to attach the ornamental article to the garment. In other embodiments, pins (straight or safety), jewelry (such as tie pins, stick pins, earrings, broaches, cameos or other such items) can be used to attach the ornamental article to a shirt or blouse. Persons having skill in the art will recognize that there are a large variety of ways of attaching an ornamental article or garment embellishment, of the type described, to a shirt, blouse or shirt-like garment, without departing from the novel scope of the present invention.

It is to be understood that any type of shirt or blouse may be worn while using the garment embellishment, including, but not limited to: button down shirts, blouses, pullover shirts, turtleneck shirts, T-shirts, sweatshirts, sweaters, and each with or without a collar and/or with short or long sleeves. Further the garment embellishment of the present invention may be worn with all-in-one clothing such as overalls, jump suits, dresses, uniforms and others, without departing from the novel scope of the present invention.

A more detailed explanation of the invention is provided in the following description and claims and is illustrated in the accompanying drawings.

DETAILED DESCRIPTION OF THE ILLUSTRATIVE EMBODIMENT

Figure 1:
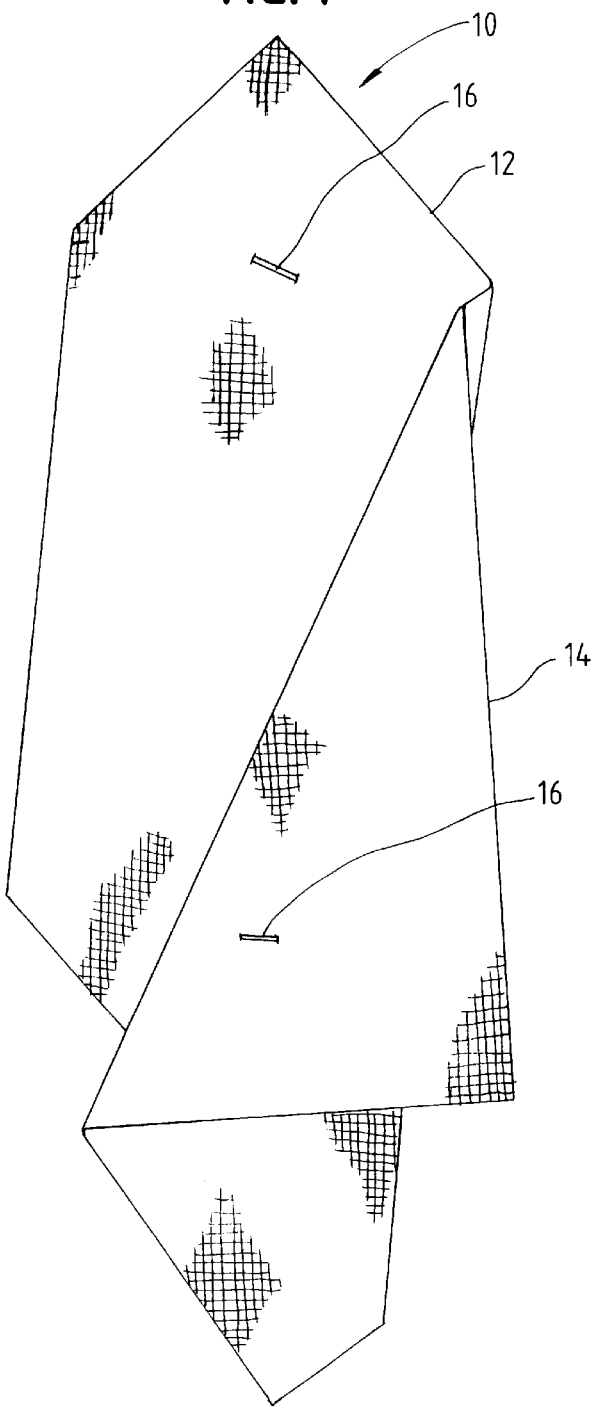
FIG. 1 is a front view of a garment embellishment of the present invention.

Referring to the drawings, a garment embellishment 10 made of cloth 12 folded to a desirable shape is shown. It can be seen that embellishment 10 has been formed from a small American flag 14. In this instance, the flag has been folded from its generally rectangular shape into the shape of embellishment 10. It is to be understood that while the shape of embellishment 10 is a pleasing shape, somewhat reminiscent of the shape of a standard necktie, any number of shapes can be created for embellishment 10 without departing from the novel scope of the present invention. Further, it is to be understood that a segment of cloth, which is not folded, can also be used without departing from the novel scope of the present invention.

Figure 2:
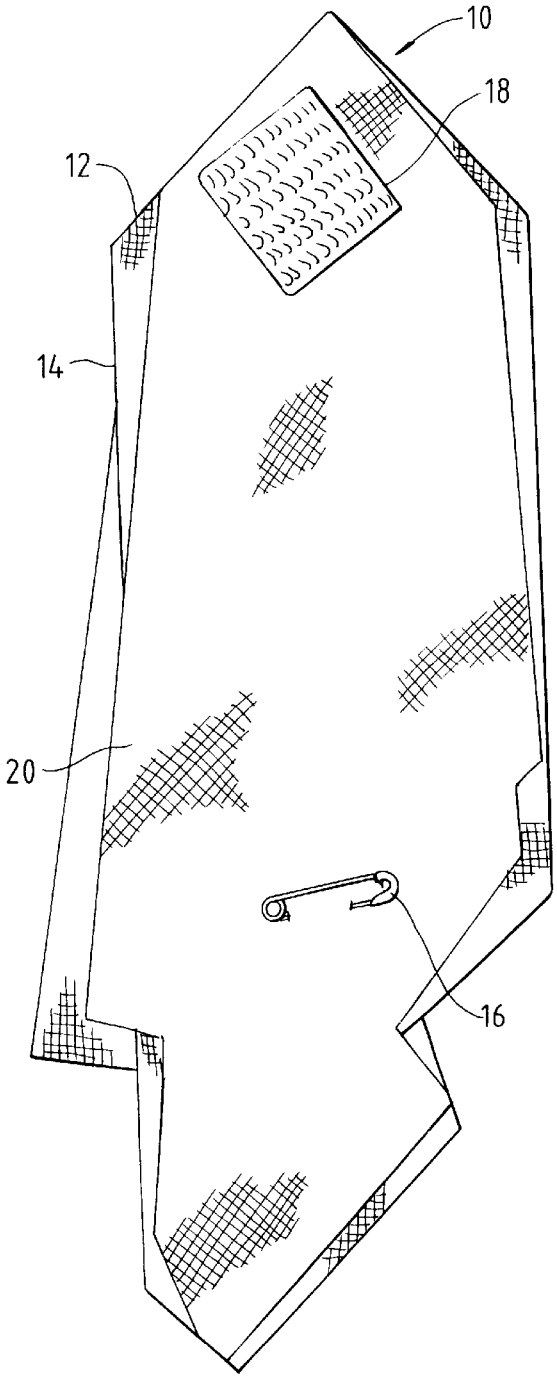
FIG. 2 is a rear view, showing one form of attachment means, of the garment embellishment of FIG. 1.

In FIGS. 1 and 2, it can be seen that embellishment 10 has been formed by folding a small flag 14 and fastening the folds with pins 16 (in this instance, safety pins). A small portion of a reinforcing batting 20 has been attached (with pins 16) to folded flag 14, and a means to fasten 18 embellishment 10, in this instance one part of a hook and loop fastener (for example, a Velcro® brand fastener) has been attached (using the adhesive provided by the hook and loop fastener) to embellishment 10 on batting 20. It will be readily understood that the other portion of the hook and loop fastener 18 will be attached to the garment onto which garment embellishment 10 will be attached. Those having skill in the art will recognize that various sets of fasteners 18 can be used at various locations on embellishment 10 and, concomitantly, on the garment to be embellished.

It can be seen, by those having skill in the art, that any type of cloth 12, including silk, wool, chintz, lamé, polyester and other man made fabrics, fabric blends and/or any other traditional fabric materials can be used in the creation of the embellishment of the present invention. Further, the embellishment of the present invention can also be created from such materials as leather, with and without printing or embossing thereon, paper, plastic, and metals, including woven metals and light weight metals, all being either in their raw or plain form or having a variety of colors and/or printing, etching, coloring or other decorative elements, without departing from the novel scope of the present invention. It can also be understood that any of a number of manners of forming the material into a shape and maintaining the shape can be used without departing from the novel scope of the present invention. For example, instead of pins 16, an embellishment 10 can be made by folding the material to the desired shape and sewing some maintenance stitches into the fabric. Further, a more finished appearance can be created by sewing the embellishment in the manner used to sew and finish a fine neck tie or scarf. Also, in the use of metals in the making of an embellishment any manner of metal forming (such as cutting from sheet metal or casting) and fastening, including nuts and bolts, rivets, soldering and welding, can be used to achieve a desirable shape (and decorative effect) for the embellishment without departing from the novel scope of the present invention. Further, with respect to all of the above-mentioned materials, the material can be cut, molded or cast to a desirable form, without folding, and used as a garment embellishment of the present invention.

In all embodiments of the garment embellishment of the present invention, it is understood that further embellishment, in the form of jewelry, precious and semi-precious stones, carvings, imprintings, etchings, printing, painting, coloring, embossing, addition of photographs and photographic elements, and other myriad forms of decoration can be made without departing from the novel scope of the present invention.

As shown in FIG. 2, a hook and loop fastener 18 has been used to permit the attachment of embellishment 10 to a garment (not shown). It is to be understood that any manner of attachment of embellishment 10 to a garment can be used without departing from the novel scope of the present invention. Such means as hook and loop fasteners 18 (as shown in FIG. 2), fabric tape, double-sided tapes, buttons, hook and eye means, snaps, ordinary pins (such as straight pins or safety pins), tie pins, other jewelry pieces (such as earrings, stick pins, brooches, cameo pins and others) and others, are all contemplated and would not depart from the novel scope of the present invention. Further, embellishment 10 can be in the form of an iron-on transfer, a silk screen transfer or an embroidered element, all of which can be permanently applied to a cloth or other material and applied to a garment.

Figure 3:
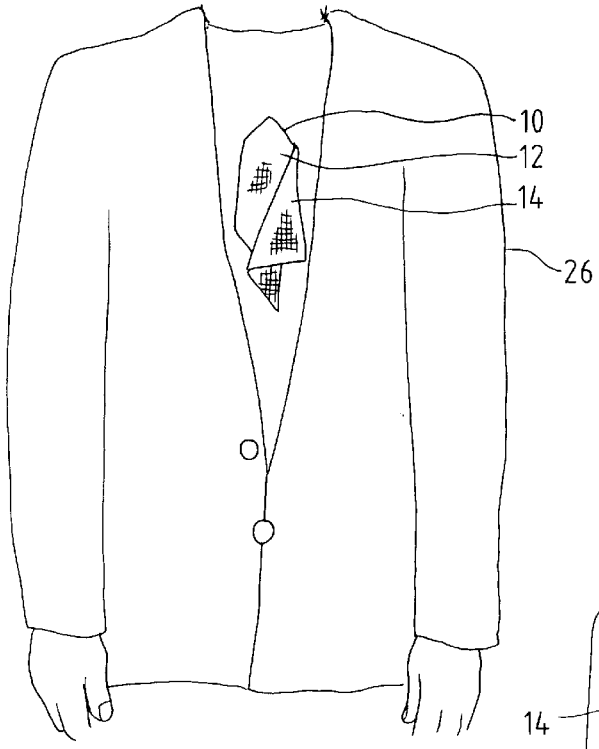
FIGS. 3 and 4 are perspective views of the garment embellishment of FIG. 1, attached to a garment and worn with a buttoned and unbuttoned sports jacket or blazer.
Figure 4:
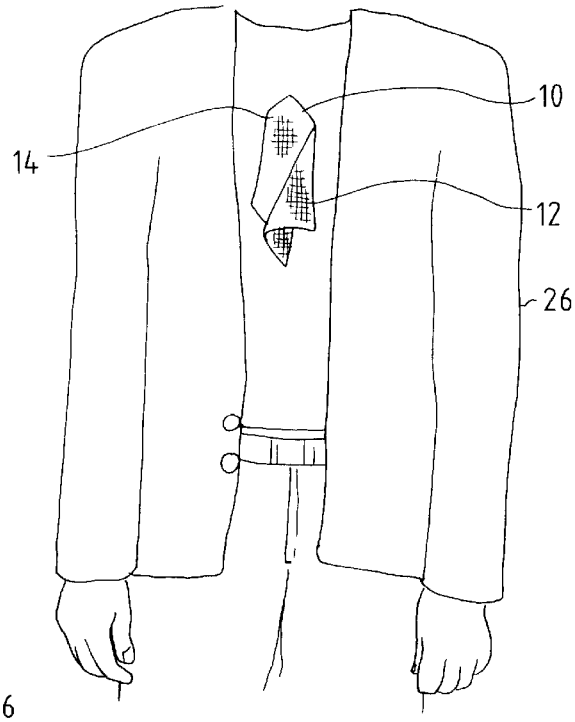
Figure 5:
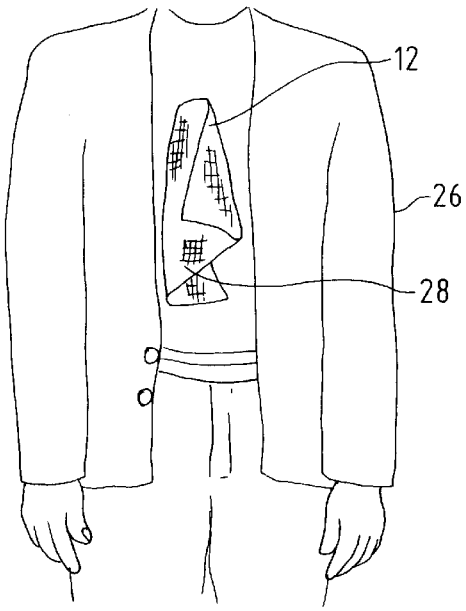
FIG. 5 is a perspective view of another embodiment of the garment embellishment of the present invention, attached to a garment and worn with a blazer.

Referring to the remaining figures, it can be seen that garment embellishment 10 can take a number of forms and can be worn in a number of ways to provide a more formal or decorative look to a number different ensembles. FIGS. 3 and 4 show the use of embellishment 10 of FIGS. 1 and 2 used with a blazer 26. In FIG. 1, blazer 26 is shown closed to present a more formal appearance. In FIG. 3, blazer 26 is shown open for an intermediate look. In FIG. 5, another embellishment 28 is shown within blazer 26. Embellishment 28 is shown as a larger embellishment in order to demonstrate the variety of sizes possible. It will be understood that the buttoning of blazer 26 would hide a portion of embellishment 28, in a manner similar to the manner that a blazer 26 would hide a portion of traditional neck tie, giving a more formal appearance than the shorter embellishment 10. Further, it will be understood that while embellishments of the present invention (such as embellishments 10 and 28) can be made in a variety of sizes, adjustment of formal neckwear of the prior art is more difficult or impossible to achieve. As such, a person having a large neck circumference can never be able to cause a standard necktie to fit to the length required by fashion of the day, yet can find that extra long neckties are much too large for him. In such situations, an embellishment of the present invention is an ideal substitute as it can always be made to the right length and will require no adjustment or complex fastening or knot tying skill to achieve the correct length. Embellishment 10, as illustrated, is approximately 7½ inches in length, embellishment 28, as illustrated, is approximately 13¼ inches in length. It is to be understood that an embellishment of the present invention can range anywhere between the lengths of embellishments 10 and 28, or can be shorter or longer than the illustrative embodiments, without departing from the novel scope of the present invention. Such lengths allow for the use by individuals of a variety of sizes and for changes in fashions and style.

While embellishment 28 is illustrated as another American flag, any manner of decorative material, as described above, can be substituted without departing from the novel scope of the present invention.

Figure 6:
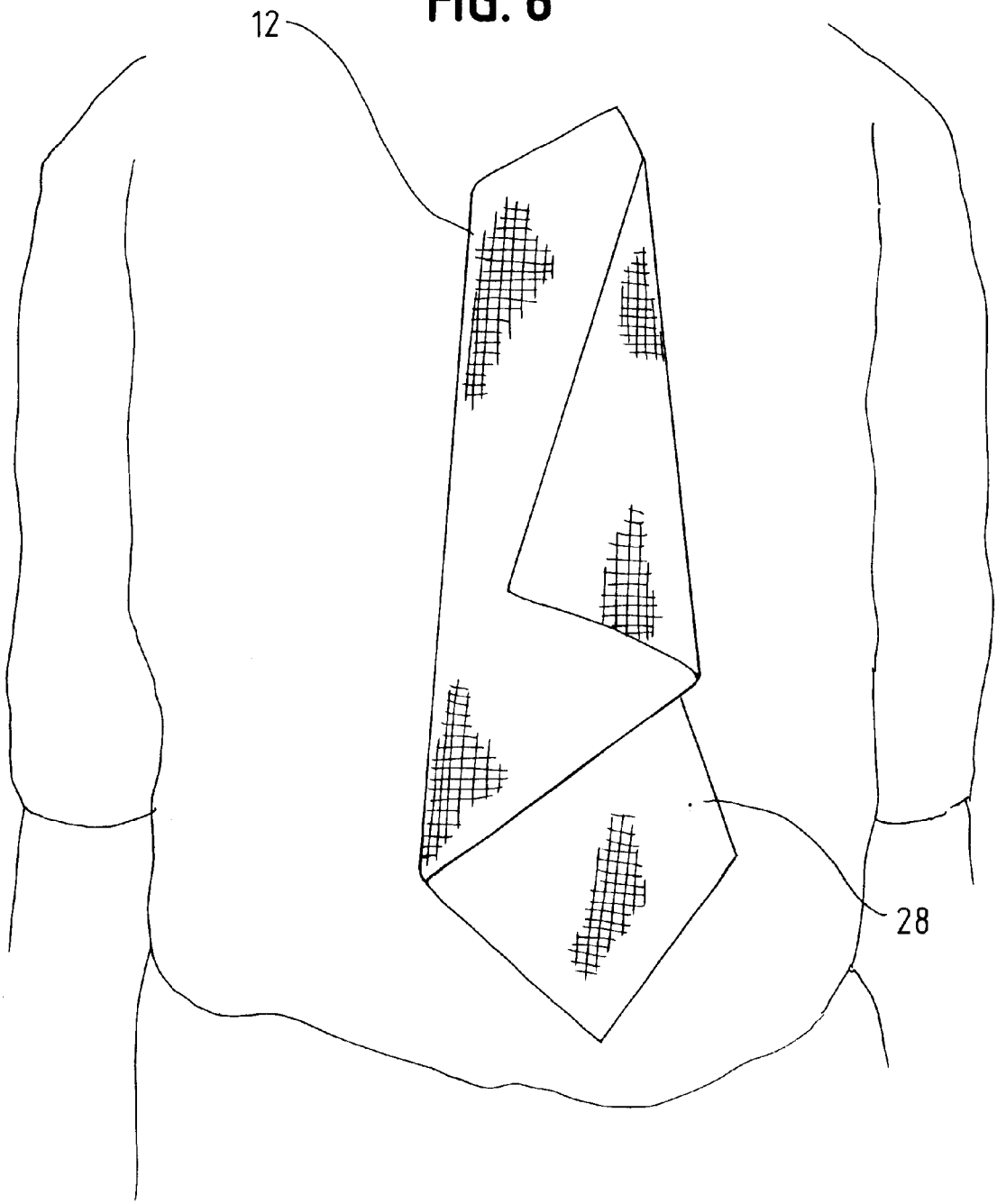
FIG. 6 is a perspective view of the garment embellishment of FIG. 5, worn without a blazer.
Figure 7:
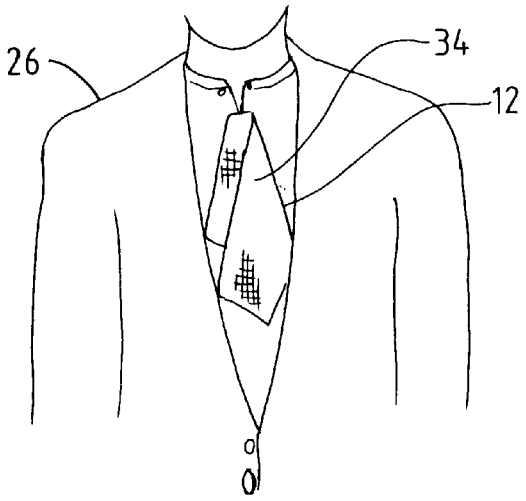
FIGS. 7 and 8 are perspective views of another embodiment of the garment embellishment of the present invention worn with and without a blazer.
Figure 8:
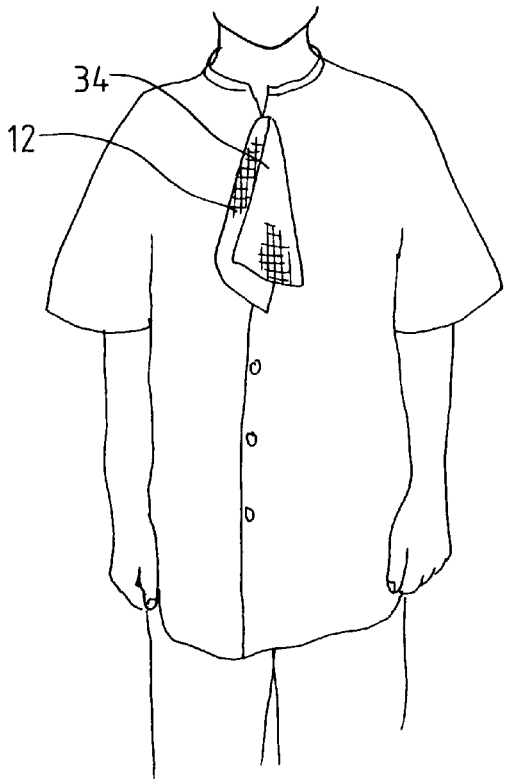

FIG. 6 illustrates the use of embellishment 28 (FIG. 5) on a short sleeve casual shirt. FIGS. 7 and 8 are illustrations of another embellishment 34 of the present invention. It can be seen in FIGS. 7 and 8 that embellishment 34 can be worn by a child or adolescent to augment the casual attire usually worn by children and teens. The addition of a blazer 26, provides a more formal look which might be necessary when traveling with a child or adolescent or when taking formal photographs of such individuals. FIG. 8 illustrates the more formal look presented by the use of embellishment 34 on a collarless short sleeve shirt 26 that has not been tucked into the pants of the wearer.

In the use of the embellishments (10, 28 and 34) of the present invention, the user can carry one with him in a pocket, briefcase, purse, backpack or other place so that at any moment the embellishment can be applied. Further, embellishments can be made available in vending machines for quick purchase before entering a theater, restaurant, temple or church, government office, school or business location. The casually dressed individual can at any point decide that his present situation has become more formal and that embellishment of the casual attire presently being worn is necessary. The individual can then either retrieve his embellishment from a convenient storage location, purchase one from a nearby store (any type of store can sell the easily stored embellishments), purchase one from a vending machine, borrow one from a restaurant, temple or church, and quickly apply the embellishment to the garment worn on the torso, instantly dressing up the informal attire being worn.

Although an illustrative embodiment of the invention has been shown and described, it is to be understood that various modifications and substitutions can be made by those skilled in the art without departing from the novel spirit and scope of the invention.

What is claimed is:

1. A garment embellishment for use with a standard shirt or blouse, comprising:

an ornamental article, having one of a plurality of forms, said ornamental article being free of neck or collar attachment means;

said ornamental article being applied to the torso of said standard shirt or blouse, such that said article may decorate the torso of said shirt or blouse.

2. The garment embellishment of claim 1, wherein said ornamental article is applied to said shirt or blouse with hook and loop fasteners.

3. The garment embellishment of claim 1, wherein said ornamental article is applied to said shirt or blouse with adhesives.

4. The garment embellishment of claim 1, wherein said ornamental article is applied to said shirt or blouse with double sided adhesive tape.

5. The garment embellishment of claim 1, wherein said ornamental article is applied to said shirt or blouse with mechanical fasteners.

6. The garment embellishment of claim 1, wherein said ornamental article is comprised of fabric.

7. The garment embellishment of claim 1, wherein said ornamental article is comprised of leather.

8. The garment embellishment of claim 1, wherein said ornamental article is comprised of metal.

9. The garment embellishment of claim 1, wherein said ornamental article is made of paper.

10. The garment embellishment of claim 9, wherein said paper is printed with a message or design.

11. The garment embellishment of claim 1, wherein said ornamental article is decorated.

12. The garment embellishment of claim 1, wherein said ornamental article is approximately seven inches in length.

13. The garment embellishment of claim 1, wherein said ornamental article is approximately 12 inches in length.

14. The garment embellishment of claim 1, wherein said ornamental article is worn in conjunction with the wearing of a jacket or blazer, of the type having a generally V-shaped opening at the upper torso when buttoned, such that when said ornamental article is applied to said shirt or blouse and said jacket or blazer is worn, said ornamental article generally decorates the area of said shirt or blouse exposed within said generally V-shaped opening of said jacket or blazer.

15. The garment embellishment of claim 1, wherein said ornamental article may be applied at any generally vertical location along the torso of the wearer.

16. A garment embellishment for use when a jacket or blazer is worn with a standard shirt or blouse, comprising:

an ornamental article, having one of a plurality of forms, said ornamental article being free of neck or collar attachment means;

said ornamental article being releasably applied to the torso of a first garment worn beneath said jacket or blazer, within the generally V-shaped opening generally formed in the front of a jacket or blazer, such that said article may be quickly added to decorate the exposed area of said first garment, while said garment is worn, and subsequently quickly removed from said garment, while said garment is worn.

17. A method of embellishing a garment, including the steps of:

providing a first garment comprising a standard shirt or blouse;

providing an ornamental article, having one of a plurality of forms, said ornamental article being free of neck or collar attachment means;

dressing in said first garment; and releasably attaching said ornamental article to the torso of said first garment, such that said ornamental article can be worn on said garment and can subsequently be easily and quickly removed from said garment while said garment is worn.

18. The method of embellishing a garment of claim 17, including the step of applying said ornamental article to said shirt or blouse with hook and loop fasteners.

19. The method of embellishing a garment of claim 17, including the step of applying said ornamental article to said shirt or blouse with adhesives.

20. The method of embellishing a garment of claim 17, including the step of applying said ornamental article to said shirt or blouse with double-sided adhesive tape.

21. The method of embellishing a garment of claim 17, including the step of applying said ornamental article to said shirt or blouse with mechanical fasteners.

22. The method of embellishing a garment of claim 17, including the step of providing an ornamental article comprised of fabric.

23. The method of embellishing a garment of claim 17, including the step of providing an ornamental article comprised of leather.

24. The method of embellishing a garment of claim 17, including the step of providing an ornamental article comprised of metal.

25. The method of embellishing a garment of claim 17, including the step of providing an ornamental article comprised of paper.

26. The method of embellishing a garment of claim 25, including the step of printing a message or design on said ornamental article.

27. The method of embellishing a garment of claim 17, including the step of decorating said ornamental article.

28. A method of embellishing a garment, including the steps of:

providing a first garment comprising a standard shirt or blouse;

providing an outer garment having an open torso area:

providing an ornamental article, having one of a plurality of forms, said ornamental article being free of neck or collar attachment means;

dressing in said first garment and said outer garment; and, releasably attaching said ornamental article to the torso of said first garment, such that said ornamental article is viewable generally within the open torso area of said outer garment, said ornamental article decorates the exposed area of said first garment, said ornamental article being subsequently quickly and easily removable from said garment while said garment is worn.

29. A garment embellishment for use with a shirt or blouse, said shirt or blouse being of a standard material that is not a substantially flexible material having a multiplicity of loop elements, said garment embellishment comprising:

an ornamental article, having one of a plurality of forms, said ornamental article being free of neck or collar attachment means;

said ornamental article being applied to the torso of said shirt or blouse, such that said article may decorate the torso of said shirt or blouse.

* * * * *